US010203125B2

(12) United States Patent
Osawa

(10) Patent No.: US 10,203,125 B2
(45) Date of Patent: Feb. 12, 2019

(54) AIR FLOW RATE CONTROLLING SYSTEM AND AIR FLOW RATE CONTROLLING METHOD

(71) Applicant: Azbil Corporation, Tokyo (JP)

(72) Inventor: Nobuo Osawa, Tokyo (JP)

(73) Assignee: AZBIL CORPORATION, Tokyo (JP)

( * ) Notice: Subject to any disclaimer, the term of this patent is extended or adjusted under 35 U.S.C. 154(b) by 681 days.

(21) Appl. No.: 14/794,271

(22) Filed: Jul. 8, 2015

(65) Prior Publication Data

US 2016/0018121 A1 Jan. 21, 2016

(30) Foreign Application Priority Data

Jul. 15, 2014 (JP) ..... 2014-144740

(51) Int. Cl.
*F24F 11/00* (2018.01)
*F24F 11/72* (2018.01)
*F24F 110/40* (2018.01)

(52) U.S. Cl.
CPC ..... *F24F 11/0001* (2013.01); *F24F 11/72* (2018.01); *F24F 2110/40* (2018.01)

(58) Field of Classification Search
CPC .. F24F 11/0001; F24F 11/022; F24F 11/0086; F24F 2011/0052; F24F 7/08
USPC ..... 454/56, 238
See application file for complete search history.

(56) References Cited

U.S. PATENT DOCUMENTS

2012/0270488 A1* 10/2012 Fujimura ..... F24F 11/0001 454/56
2012/0289139 A1 11/2012 Fujimura et al.

FOREIGN PATENT DOCUMENTS

JP 2012-237527 A 12/2012
KR 100601221 B1 7/2006

OTHER PUBLICATIONS

Korean Office Action dated Dec. 1, 2016 issued in corresponding Korean Patent Application No. 10-2015-0100385.

* cited by examiner

*Primary Examiner* — Gregory Huson
*Assistant Examiner* — Dana Tighe
(74) *Attorney, Agent, or Firm* — Oblon, McClelland, Maier & Neustadt, L.L.P.

(57) ABSTRACT

A flow rate controlling system includes: a flow rate balance determining portion that determines a supply flow rate, regulated by a supply air valve, and a common exhaust flow rate, regulated by a common exhaust air valve, so that a difference between the supply flow rate and an exhaust flow rate, regulated by the common exhaust air valve, matches a set point; a valve monitoring portion that monitors the supply air valve, the common exhaust air valve, and a local exhaust air valve; and a flow rate changing portion that issues a flow rate changing instruction to the flow rate balance determining portion. When there is a fault in the supply air valve and/or the common exhaust air valve, the flow rate balance determining portion, upon receipt of the flow rate changing instruction from the flow rate changing portion, changes neither the supply nor common exhaust flow rate.

12 Claims, 4 Drawing Sheets

Background Art

AIR FLOW RATE CONTROLLING SYSTEM AND AIR FLOW RATE CONTROLLING METHOD

CROSS REFERENCE TO RELATED APPLICATION

This application claims priority under 35 U.S.C. § 119 to Japanese Patent Application No. 2014-144740, filed on Jul. 15, 2014, the entire content of which being hereby incorporated herein by reference.

FIELD OF TECHNOLOGY

The present invention relates to a flow rate controlling system employee controlling method for maintaining a flow rate balance through controlling a flow rate of air supplied into a facility and controlling the exhaust flow rate.

BACKGROUND

In chemical experiments, during the process of the external operations, often biochemical substances that are harmful to humans are produced. Fume hoods are used as one type of equipment to prevent these biochemical substances from being diffused into a room and to prevent them from coming into contact with the human body. Typically, fume hoods are provided with an enclosure with a sash that can be opened either vertically or horizontally, where an operator in the laboratory can access the inside of the enclosure through the sash. So that the operator will not be exposed to harmful biochemical substances during the operations using the fume hood, the enclosure is connected to a local exhaust duct that removes the biochemical substances.

The flow rate controlling system is a system for regulating the rate of flow in a local exhaust duct so as to maintain the planar air flow rate within a sash plane at a prescribed speed so that no biochemical substance returns back into the room when an experiment involving a biochemical substance is performed within a flow hood, and to maintain a constant room pressure so that the biochemical substance will not leak out from the room and so that contaminants, and the like, from the outside it will not flow into the room. See, for example, Japanese Unexamined Patent Application Publication No. 2012-237527 (the "JP '527"). FIG. 4 is a diagram illustrating a structure for a conventional flow rate controlling system. The flow rate controlling system comprises: fume hoods 101-1 and 101-2 that are disposed within the room 100; local exhaust ducts 102-1 and 102-2 that are connected to the fume hoods 101-1 and 101-2; a supply air duct 103 for supplying supply air to the room 100; a common exhaust duct 104 for the air of the room 100; local exhaust air valves EXV1 and EXV2 for regulating the airflow rates of the local exhaust ducts 102-1 and 102-2; a supply air valve MAV for regulating the airflow rate of the supply air duct 103; a common exhaust air valve GEX for regulating the airflow rate of the common exhaust duct 104; controllers 105-1 and 105-2 for controlling the local exhaust air valves EXV1 and EXV2; a controller 106 for controlling the supply air valve MAV; a controller 107 for controlling the common exhaust air valve GEX; and communication lines 108 for connecting together the various controllers 105-1, 105-2, 106, and 107.

The fume hoods 101-1 and 101-2 are provided with sashes 111-1 and 111-2; personnel-detecting sensors 112-1 and 112-2 for detecting whether or not there is a person within the range of detection; fume hood monitors 113-1 and 113-2 for providing information to operators using the fume hoods 101-1 and 101-2; and sash sensors 114-1 and 114-2 for detecting the degrees to which the sashes 111-1 and 111-2 are open.

In the flow rate controlling system illustrated in FIG. 4, control of the openings of the supply air valve MAV, the common exhaust air valve GEX, and the local exhaust air valves EXV1 and EXV2 is carried out so that the supply air flow rate of the supply air duct 103, the exhaust flow rate of the common exhaust duct 104, and the local exhaust flow rates of the local exhaust ducts 102-1 and 102-2 will satisfy the relationship that "the supply air flow rate=the common exhaust flow rate+the local exhaust flow rates+an offset flow rate," that is, the flow rate balance control is performed.

In the flow rate controlling system illustrated in FIG. 4, if there is a master valve that oversees the flow rate balance control (for example, the supply air valve MAV) and a follower valve (for example, the common exhaust air valve GEX) that operates after having received the flow rate set point from the master valve, the master valve changes the flow rate for both the master valve and the follower valve without being able to detect a fault in the follower valve, and thus there is a problem in that in some cases the balance of the flow rates within the room may be disrupted (that is, only the master valve is opened or shut, regardless of a fault in a follower valve that prevents it from opening or shutting).

For example, let us assume that in a room that is maintained at a negative pressure, the supply air flow rate and the exhaust flow rate when operating at night, where the air turnover rate is reduced, is at a supply air flow rate of 1500 $m^3$/hour with a common exhaust flow rate at 2000 $m^3$/hour (with the local exhaust flow rates at 0 $m^3$/hour).

If there is a fault in the common exhaust air valve that prevents the flow rate from being increased or decreased then, when there is an operation that attempts to increase the turnover rate of the air during the daytime, the supply air flow rate may be set to 3000 $m^3$/hour with the common exhaust flow rate at 2000 $m^3$/hour, so the exhaust flow rate will be insufficient when compared to the normal common exhaust flow rate of 3500 $m^3$/hour, causing the interior of the room to go to an extremely positive pressure.

The present invention was created in order to solve the problem set forth above, to provide a flow rate controlling system and flow rate controlling method wherein the room pressure will not go to an extremely positive pressure or an extremely negative pressure even if there is a fault in the supply or exhaust air valve.

SUMMARY

A flow rate controlling system according to the present invention includes: a supply air valve that regulates a flow rate of supply air that is blown out into an applicable facility; a common exhaust air valve that regulates an airflow rate of exhaust air that is drawn from the applicable facility; a flow rate balance determining portion that determines a supply air flow rate, regulated by the supply air valve, and a common exhaust flow rate, regulated by the common exhaust air valve, so as to cause a difference between the supply air flow rate, regulated by the supply air valve, and the exhaust flow rate, regulated by the common exhaust air valve, to match a prescribed set point; a master valve controlling portion that controls the master valve to produce a corresponding flow rate in the master valve, determined by the flow rate balance determining portion, when, of the supply air valve and the common exhaust air valve, one is defined as the master valve and the other is defined as the follower valve; a follower valve controlling portion that controls the follower valve to produce a flow rate corresponding to the follower valve, determined by the flow rate balance determining portion; a valve monitoring portion that monitors at regular scheduled periods the states of the supply air valve and the common exhaust air valve; and a flow rate changing portion that issues a flow rate change instruction to the flow rate balance determining portion following a schedule that is established in advance or an instruction from the outside. When a flow rate change instruction has been received from the flow rate changing portion, if there is a fault in the supply air valve and/or the common exhaust air valve, the flow rate balance determining portion changes neither the supply air flow rate nor the common exhaust flow rate.

Moreover, one structural example of a flow rate controlling system according to the present invention, further includes: a local exhaust device installed in the facility; a local exhaust air valve that regulates the exhaust flow rate of the local exhaust device; and a local exhaust air valve controlling portion that controls the local exhaust air valve so that the planar air speed in the plane of the sash of the local exhaust device will go to a prescribed value. The flow rate balance determining portion determines the supply air flow rate that is regulated by the supply air valve and the common exhaust flow rate that is adjusted by the common exhaust air valve so that the difference between the supply air flow rate, regulated by the supply air valve, and the exhaust flow rate, regulated by the common exhaust air valve, will match a prescribed set point.

Moreover, one structural example of a flow rate controlling system according to the present invention, further includes: a valve state notifying portion that notifies a user of the local exhaust device that there is a fault in the supply air valve or the common exhaust air valves if there is a fault in the supply air valve and/or the common exhaust air valve.

Moreover, one structural example of a flow rate controlling system according to the present invention, further includes: a sash controlling portion that prevents opening/shutting of the sash of the local exhaust device, by controlling a mechanism for preventing opening/shutting of the local exhaust device, if there is a fault in the supply air valve and/or the common exhaust air valve.

Moreover, in one structural example of a flow rate controlling system according to the present invention: the valve monitoring portion monitors, on a regular scheduled basis, a state of the local exhaust air valve; and the valve state notifying portion notifies the user of the local exhaust device that there is a fault in the local exhaust air valve if there is a fault in the local exhaust air valve.

Moreover, in one structural example of a flow rate controlling system according to the present invention: the valve monitoring portion monitors, on a regular scheduled basis, a state of the local exhaust air valve; and the sash controlling portion prevents opening/shutting of the sash of the local exhaust device, through controlling an opening/shutting preventing mechanism of the local exhaust device, if there is a fault in the local exhaust air valve.

A flow rate controlling method according to the present invention includes: a flow rate balance determining step for determining, by a flow rate balance determining portion, a supply air flow rate, regulated by the supply air valve, and a common exhaust flow rate, regulated by the common exhaust air valve, so as to cause a difference between the supply air flow rate, regulated by the supply air valve, and the exhaust flow rate, regulated by the common exhaust air valve, to match a prescribed set point; a master valve controlling step for controlling the master valve to produce a corresponding flow rate in the master valve, determined in the flow rate balance determining step, when, of the supply air valve and the common exhaust air valve, one is defined as the master valve and the other is defined as the follower valve; a follower valve controlling step for controlling the follower valve to produce a flow rate corresponding to the follower valve, determined in the flow rate balance determining step, a valve monitoring step for monitoring at regular scheduled periods the states of the supply air valve and the common exhaust air valve; and a flow rate changing step for issuing a flow rate change instruction following a schedule that is established in advance or an instruction from the outside. When a flow rate change instruction has been received, if there is a fault in the supply air valve and/or the common exhaust air valve, the flow rate balance determining step changes neither the supply air flow rate nor the common exhaust flow rate.

Given the present invention, if there is a fault in the supply air valve and/or the common exhaust air valve, when an instruction for changing a flow rate has been received from the flow rate changing portion the supply air flow rate and the common exhaust flow rate will not change, thus making it possible to maintain the room pressure of the facility, and making it possible to prevent the room pressure from going to an extremely positive pressure or an extremely negative pressure.

Moreover, when, in the present invention, there is a fault in the supply air valve and/or the common exhaust air valve, the user of the local exhaust device is informed that there is a fault in the supply air valve or common exhaust air valve, to prompt the user to not open or shut the sash of the local exhaust device.

Moreover, when, in the present invention, there is a fault in the supply air valve and/or the common exhaust air valve, opening/shutting of the sash of a local exhaust device is prevented, making it possible to prevent the user from increasing the local exhaust flow rate by opening a sash of a local exhaust device.

Moreover, when, in the present invention, there is a fault in a local exhaust air valve, the user of the local exhaust device is informed of the fault in the local exhaust air valve, thereby making it possible to prompt the user to not open or shut the sash of the local exhaust device.

Moreover, when, in the present invention, there is a fault in a local exhaust air valve, the opening/shutting of the local exhaust device is prevented, making it possible to prevent the user from increasing the local exhaust flow rate by opening a sash of a local exhaust device.

BRIEF DESCRIPTIONS OF THE DRAWINGS

DETAILED DESCRIPTION

Figure 1:
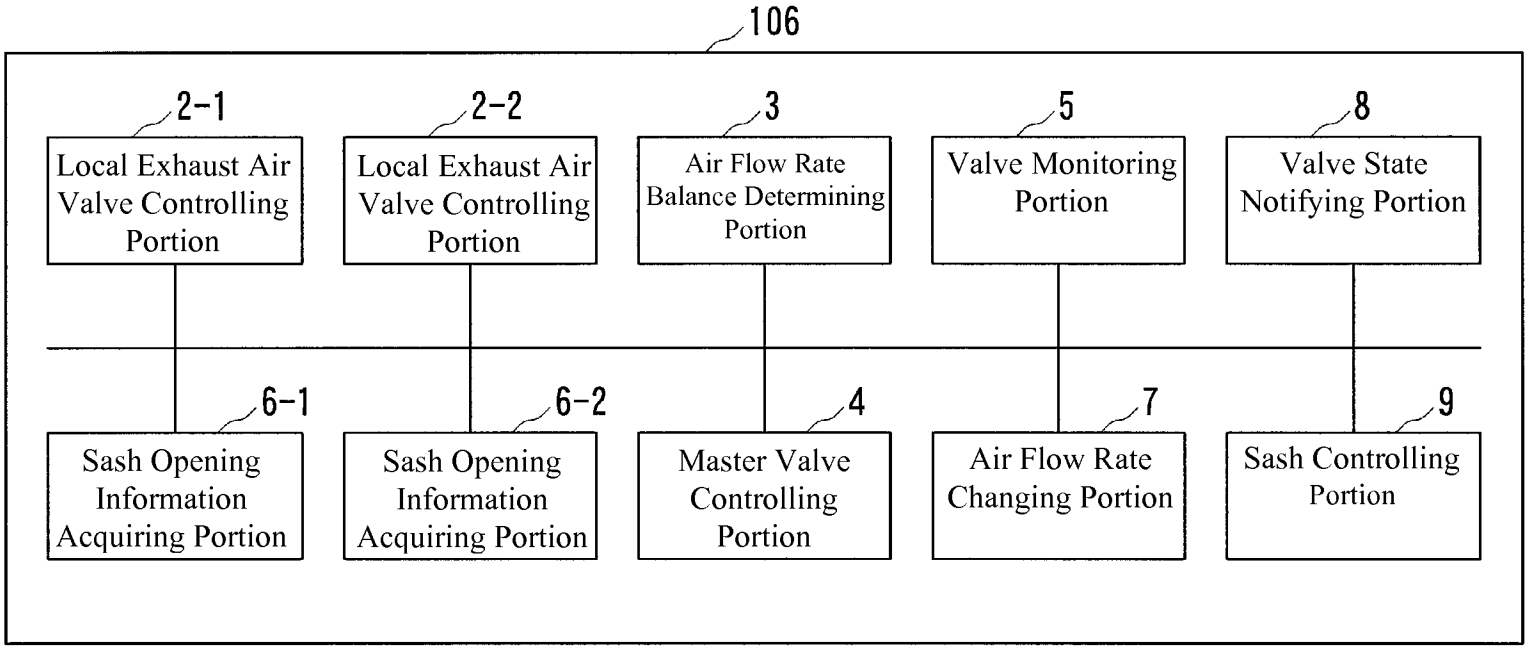
FIG. 1 is a block diagram illustrating a structure of a controller according to an example according to the present invention.
Figure 4:
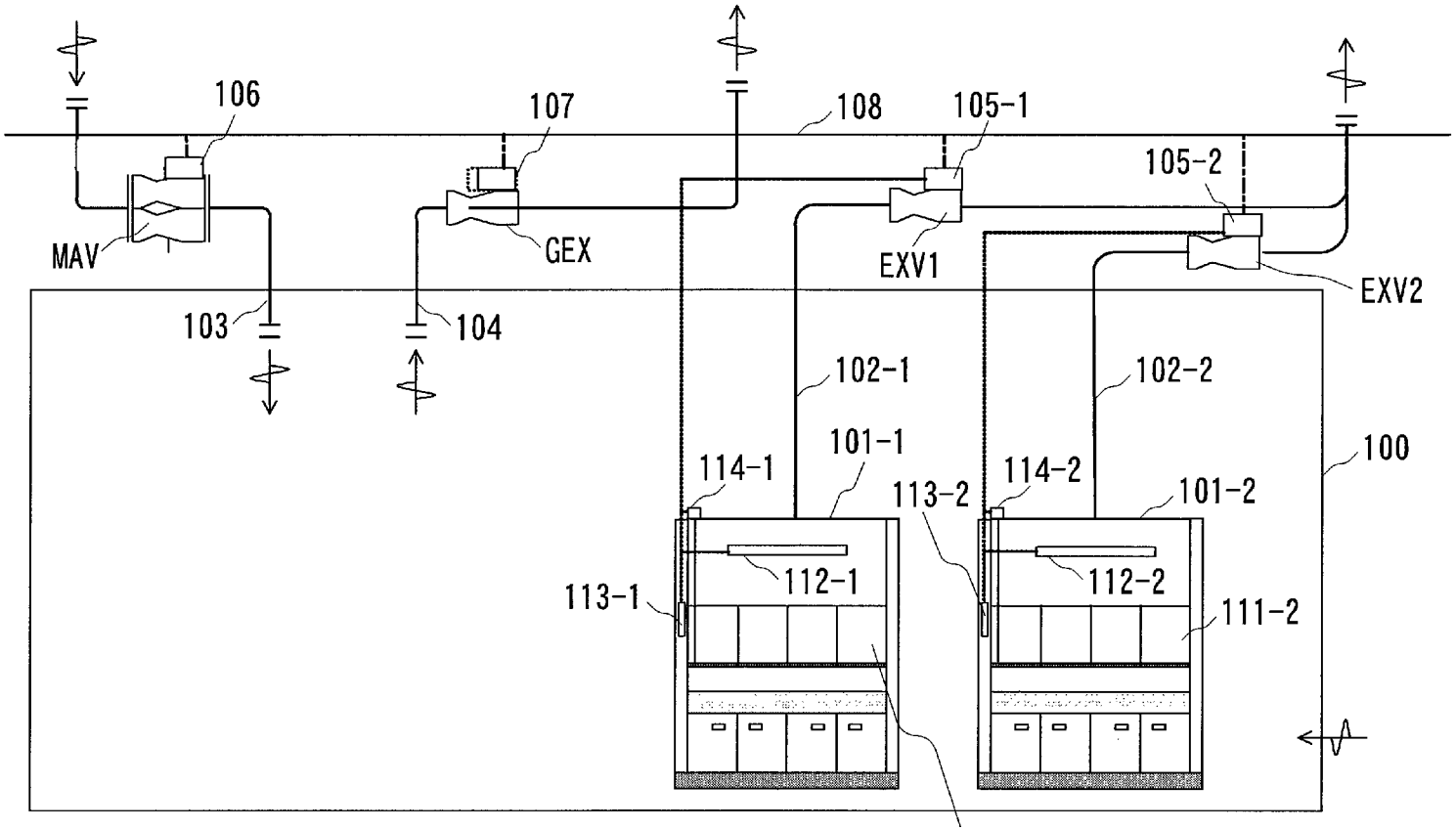
FIG. 4 is a diagram illustrating a structure of a conventional flow rate controlling system.

Forms for carrying out the present disclosure will be explained below in reference to the figures. In the present example, where structures of a flow rate controlling system are similar or correspond to those illustrated in FIG. 4, the explanation will use the codes in FIG. 4. FIG. 1 is a block diagram illustrating a structure of a controller 106 according to the present example for controlling a master valve (which, in the present example, is the supply air valve MAV) and a follower valve (which, in the present example, is the common exhaust air valve GEX).

The controller 106 comprises: local exhaust air valve controlling portions 2-1 and 2-2 provided for the individual local exhaust air valves EXV1 and EXV2; a flow rate balance determining portion 3 for determining the supply air flow rate, regulated by the supply air valve MAV, and the common exhaust flow rate, regulated by the common exhaust air valve GEX, so that the difference between the supply air flow rate, regulated by the supply air valve MAV, and the exhaust flow rate, regulated by the local exhaust air valves EXV1 and EXV2 and the common exhaust air valve GEX, will match a prescribed set point; a master valve controlling portion 4 for controlling the master valve; a valve monitoring portion 5 for monitoring the states of the supply air valve MAV, the common exhaust air valve GEX, and the local exhaust air valves EXV1 and EXV2; sash opening information acquiring portions 6-1 and 6-2 for acquiring opening information for sashes 111-1 and 111-2, equipped in the individual fume hoods 101-1 and 101-2, which are local exhaust devices; a flow rate changing portion 7 for issuing, to the flow rate balance determining portion 3, an instruction for a flow rate change, in accordance with a schedule that is set in advance or in accordance with an external instruction; a valve state notifying portion 8 for reporting valve faults to the users of the fume hoods 101-1 and 101-2; and a sash controlling portion 9 for controlling the opening/shutting of the sashes 111-1 and 111-2 of the fume hoods 101-1 and 101-2.

Figure 2:
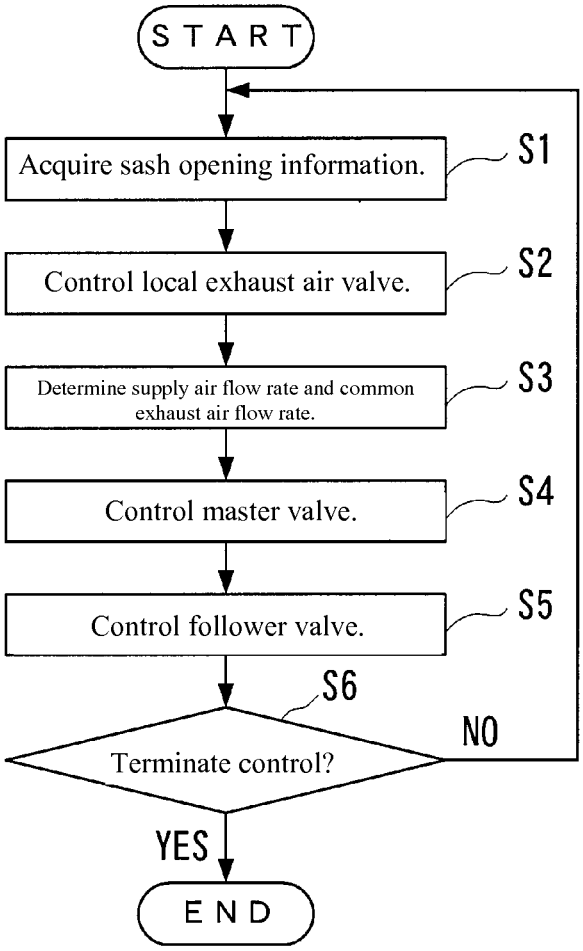
FIG. 2 is a flowchart for explaining the flow rate balance controlling operation in the flow rate controlling system according to an example according to the present invention.

The flow rate balance controlling operation in the flow rate controlling system according to the present example will be explained next. FIG. 2 is a flowchart for explaining the flow rate balance controlling operation. In the present example, the flow rate of the supply air that is blown out from the supply air duct 103 is defined as Vmav, the flow rate of the exhaust that is drawn in through the common exhaust duct 104 is defined as Vgex, and the flow rates of the exhausts that are drawn into the local exhaust ducts 102-1 and 102-2 are defined as Vexv1 and Vexv2.

The sash opening information acquiring portions 6-1 and 6-2 acquire opening information for the sashes 111-1 and 111-2 from sash sensors 114-1 and 114-2 of the fume hoods 101-1 and 101-2 corresponding thereto (Step S1 in FIG. 2).

The local exhaust air valve controlling portion 2-1 establishes the local exhaust flow rate Vexv1 so that the planar air speed in the plane of the sash will be the prescribed value (normally 0.5 m/sec) based on the opening area of the sash of the fume hood 101-1, and controls the degree of opening of the local exhaust air valve EXV1, through the controller 106-1, so that the exhaust flow rate of the local exhaust duct 102-1 will go to Vexv1 (Step S2 in FIG. 2). Similarly, the local exhaust air valve controlling portion 2-2 establishes the local exhaust flow rate Vexv2 based on the opening area of the sash of the fume hood 101-2 so that the planar air speed in the plane of the sash will be the aforementioned prescribed value based on the opening area of the sash of the fume hood 102-2, and controls the degree of opening of the local exhaust air valve EXV2, through the controller 106-2, so that the exhaust flow rate of the local exhaust duct 102 will go to Vexv2 (Step S2 in FIG. 2). Note that the sash opening areas for the fume hoods 101-1 and 101-2 can be determined by multiplying, by the known sash width, the heights of the open portions of the sashes 111-1 and 111-2, which can be calculated by the sash opening information acquired by the sash opening information acquiring portions 6-1 and 6-2.

Following this, the flow rate balance determining portion 3 determines the supply air flow rate Vmav and the common exhaust flow rate Vgex depending on the local exhaust flow rates Vexv1 and Vexv2, calculated by the local exhaust air valve controlling portions 2-1 and 2-2 so that the difference between the supply air flow rate Vmav and the exhaust flow rate (Vgex+Vexv1+Vexv2) will match the prescribed set point a (Step S3 and FIG. 2):

$$Vmav=Vgex+Vexv1+Vexv2+\alpha \quad (1)$$

The set point $\alpha$ in Equation (1) is an offset flow rate that not only determines the rate of flow of leakage from the applicable facility (room 100 in FIG. 4), but that also determines whether the room 100 will be under positive pressure or negative pressure. Note that the flow rate balance determining portion 3 determines the supply air flow rate Vmav so that at least a minimum rate of flow will always be blown out, so as to satisfy a minimum air circulation flow rate for the room 100.

The master valve controlling portion 4 controls the degree of opening of the master valve (the supply air valve MAV in the present example) so that the flow rate in the supply air duct 103 will be the flow rate Vmav determined by the flow rate balance determining portion 3 (Step S4 in FIG. 2).

The controller 107, which is the follower valve controlling portion, controls the degree of opening of the follower valve (the common exhaust air valve GEX in the present example) so that the flow rate in the common exhaust duct 104 will be the flow rate Vgex determined by the flow rate balance determining portion 3 (Step S5 in FIG. 2).

The procedures in Step S1 through S5 are repeated at control intervals in this way until the flow rate control is terminated through an instruction from, for example, a user (YES in Step S6 in FIG. 2).

The flow rate balance controlling operations described above cause the supply air flow rate Vmav and the exhaust flow rate Vgex to change commensurately when there is a change in a local exhaust flow rate Vexv1 and/or Vexv2 accompanying opening or setting of a sash 111-1 and/or 111-2 of the fume hoods 101-1 and 101-2.

As another example wherein the supply air flow rate Vmav and the exhaust flow rate Vgex are changed, there is a flow rate change controlling operation that reduces the supply air flow rate Vmav and the exhaust flow rate Vgex, while maintaining a constant pressure differential between the inside and the outside of the room, so as to conserve energy during a time band when no one is present (such as evenings and holidays, wherein no operations are performed). This change in the airflow rate, on weekdays, is performed every day. In the example of switching the time band from daytime to nighttime, both the supply airflow rate Vmav and the exhaust airflow rate Vgex are gradually decreased, and in the example of switching the time band from nighttime to daytime, both the supply airflow rate Vmav and the exhaust airflow rate Vgex are gradually increased. Moreover, an instruction for changing a flow rate may be received from the outside accompanying control of the temperature of the room 100.

Figure 3:
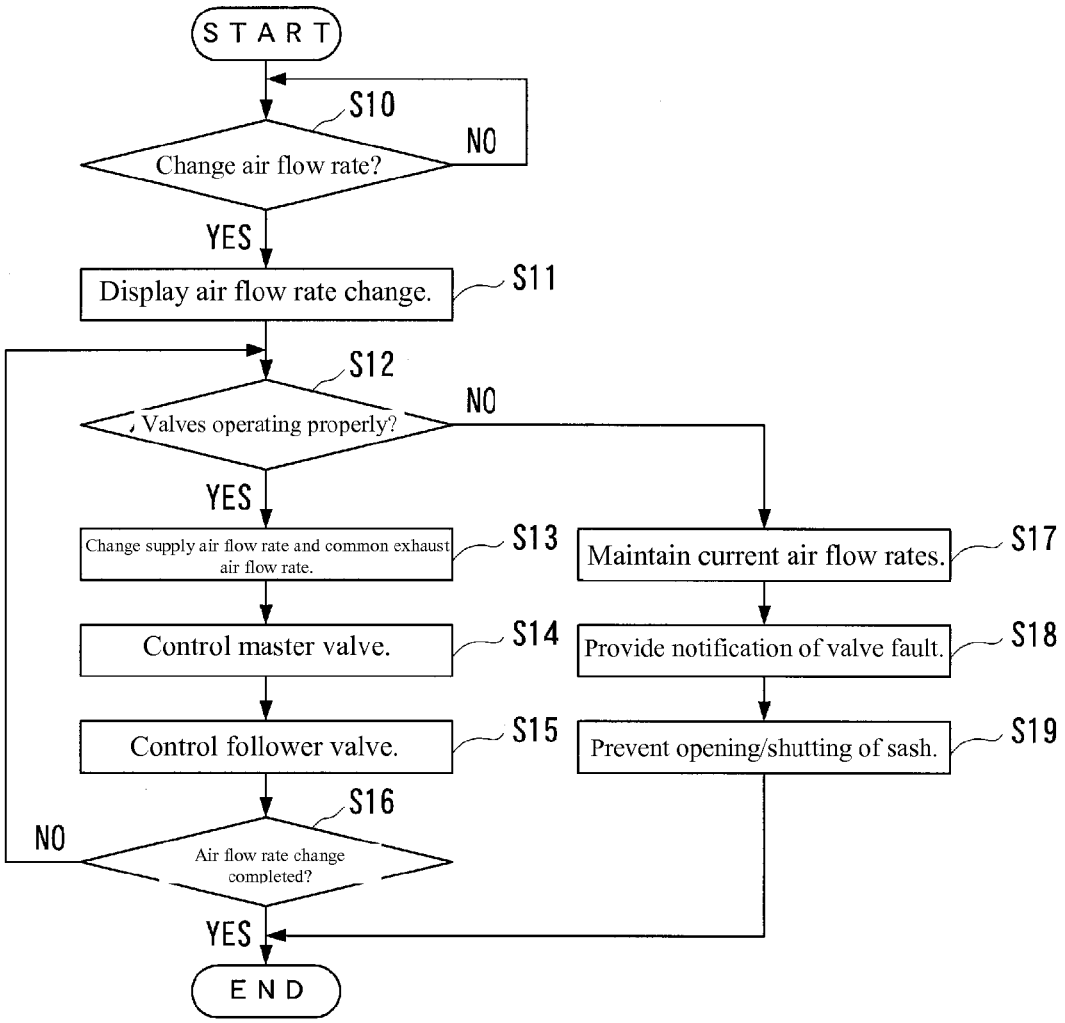
FIG. 3 is a flowchart for explaining the air flow rate change controlling operation in an air flow rate controlling system according to an example according to the present disclosure.

The airflow rate change controlling operation will be explained next. FIG. 3 is a flowchart for explaining the airflow rate change controlling operation.

When the flow rate is to be changed in accordance with a schedule that is set in advance (for example, when switching from the daytime to nighttime hours or when switching from nighttime to daytime hours), or when an instruction for changing the flow rate has been received from the outside (YES in Step S10 in FIG. 3), then the flow rate changing portion 7 issues, to the flow rate balance determining portion 3, an instruction to change the supply air flow rate Vmav (Step S11 in FIG. 3).

The flow rate balance determining portion 3 that has received any instruction from the flow rate changing portion 7 checks, through the valve monitoring portion 5, whether or not the supply air valve MAV and the common exhaust air valve GEX are operating properly (Step S12 in FIG. 3). The valve monitoring portion 5, on a regular periodic basis, monitors the states of the supply air valve MAV and the common exhaust air valve GEX.

If the evaluation is that the supply air valve MAV and the common exhaust air valve GEX are normal (YES in Step S12), then the flow rate balance determining portion 3 gradually changes the supply air flow rate Vmav (Step S13 in FIG. 3). At this time, the flow rate balance determining portion 3 also changes the exhaust flow rate Vgex in accordance with the change in the supply air flow rate Vmav, to determine the exhaust flow rate Vgex so that Equation (1) will be satisfied after the change in flow rates as well.

The master valve controlling portion 4 controls the degree of opening of the master valve (the supply air valve MAV in the present example) so that the flow rate in the supply air duct 103 will go to the flow rate Vmav that was determined by the flow rate balance determining portion 3 (Step S14 in FIG. 3).

The controller 107, which is the follower valve controlling portion, controls the degree of opening of the follower valve (which is the common exhaust air valve GEX in the present example) so that the exhaust flow rate in the common exhaust duct 104 will go to the flow rate Vgex that has been determined by the flow rate balance determining portion 3 (Step S15 in FIG. 3).

The procedures in Step S12 through S15 are repeated at regular periodic intervals in this way until the supply air flow rate Vmav arrives at a flow rate value that has been set in advance or at a flow rate value designated externally (YES in Step S16 of FIG. 3). The flow rate balancing control after the change of flow rate is as described above.

On the other hand, if there is an evaluation that the supply air valve MAV and/or the common exhaust air valve GEX is faulty and not operating (NO in Step S 12), then the flow rate balance determining portion 3 maintains the current supply air flow rate Vmav and exhaust flow rate Vgex, without changing the flow rates, to maintain a constant room pressure (Step S17 in FIG. 3).

Moreover, the valve state notifying portion 8, when there is a fault in the supply air valve MAV and/or the common exhaust air valve GEX, notifies the users of the fume hoods 101-1 and 101-2, through the fume hood monitors 113-1 and 113-2, that there is a fault in the supply air valve MAV and/or the common exhaust air valve GEX (Step S18 in FIG. 3).

Moreover, if an opening/shutting preventing mechanism, for preventing the sashes 111-1 and 111-2 from being opened/shut is provided in the fume hoods 101-1 and 101-2, then the sash controlling portion 9 controls the opening/shutting preventing mechanisms to make it so that the sashes 111-1 and 111-2 cannot be opened/shut (Step S19 in FIG. 3).

If there is a fault such that the supply air valve MAV or the common exhaust air valve GEX cannot be operated, then if the local exhaust flow rate Vexv1 or Vexv2 were to increase through opening of the sash 111-1 or 111-2, then the interior of the room would go to an extremely negative pressure. In order to prevent such a situation, if there is a fault in the supply air valve MAV or the common exhaust air valve GEX, then it is possible to prompt, through the fume monitors 113-1 and 113-2, the users of the fume hoods 101-1 and 101-2 to not open or shut the sashes 111-1 and 111-2 through outputting audio such as, for example, "The supply air valve is faulty—Please do not use" or "The common exhaust air valve is faulty—Please do not use."Moreover, if opening/shutting preventing mechanisms are provided in the fume hoods 101-1 and 101-2, the opening/setting of the sashes 111-1 and 111-2 can also be achieved.

As described above, if, in the present example, there is a fault in the supply air valve MAV and/or the common exhaust air valve GEX, there is no change in the supply air flow rate Vmav or the exhaust flow rate Vgex, and thus it is possible to maintain the room pressure of the facility, making it possible to prevent the room pressure from going to an extremely positive pressure or to an extremely negative pressure.

Note that while the explanation in the present example was for a case wherein there was a fault in the supply air valve MAV or the common exhaust air valve GEX, the fault notification and the prevention of opening/shutting of the sashes 111-1 and 111-2 is also possible in a case wherein there is a fault in a local exhaust air valve EXV1 or EXV2.

That is, if there is a fault in an exhaust air valve EXV1 or EXV2, the valve state notifying portion 8 can prompt the users of the fume hoods 101-1 and 101-2 to not open or shut the sashes 111-1 and 111-2 by outputting, from the fume hood monitors 113-1 and 113-2, audio such as "The local exhaust air valve is faulty—Please do not use." Moreover, the sash controlling portion 9 will control the opening/shutting preventing mechanisms of the fume hoods 101-1 and 101-2 to prevent opening/shutting of the sashes 111-1 and 111-2.

Each individual controller 105,106, and 107 explained in the present example can be embodied through a computer that is provided with a CPU (Central Processing Unit), a memory device, and an interface, and a program for controlling these hardware resources. The controllers for each of these CPUs 105,106, and 107 execute the processes explained the present example through a program that is stored in the memory device.

Note that while in the present example notification of a valve fault is through audio, there is no limitation thereto, and instead the notification me be through flashing an LED or sounding a buzzer.

While in the present example the local exhaust air valve controlling portions 2-1 and 2-2 and the sash opening information acquiring portions 6-1 and 6-2 are provided in the controller 106, these may instead be provided in the controllers 105-1 and 105-2.

Moreover, while in the present example a fume hood was used as one local exhaust device, the present disclosure can be applied also to devices that achieve the same role as a fume hood, such as a safety cabinet, and the like.

Moreover, while in the present example the explanation was for a structure wherein fume hoods 101-1 and 101-2 (local exhaust devices), local exhaust air valves EXV1 and EXV2, and local exhaust air valve controlling portions 2-1 and 2-2 are provided, there is no limitation thereto, but rather the present invention may also be applied to a structure wherein there are no fume hoods 101-1 or 101-2, no local exhaust air valves EXV1 or EXV2, and no local exhaust air valve controlling portions 2-1 and 2-2 (that is, Vexv1=Vexv2=0).

The present invention can be applied to a flow rate controlling system.

The invention claimed is:

1. A flow rate controlling system, comprising:

a supply air valve that regulates a flow of supply air that is blown out into a facility;

a common exhaust air valve that regulates a flow of exhaust air that is drawn from the facility; and a controller including a CPU and configured to determine a supply flow rate, regulated by the supply air valve, and a common exhaust flow rate, regulated by the common exhaust air valve, so as to cause a difference between the supply flow rate, regulated by the supply air valve, and the exhaust flow rate, regulated by the common exhaust air valve, to match a prescribed set point;

control a master valve to produce a corresponding flow rate in the master valve, as determined by the controller when, of the supply air valve and the common exhaust air valve, one is defined as the master valve and the other is defined as a follower valve;

control the follower valve to produce a flow rate corresponding to the follower valve, as determined by the controller, monitor, at regular scheduled periods, states of the supply air valve and the common exhaust air valve, and issue a flow rate change instruction according to a schedule that is established in advance or an instruction from outside, wherein:

when both (i) the flow rate change instruction is received, and (ii) there is a fault in at least one of the supply air valve and the common exhaust air valve, the controller maintains the supply flow rate and the common exhaust flow rate, without changing either the supply flow rate or the common exhaust flow rate.

2. The flow rate controlling system as set forth in claim 1, further comprising:

a local exhaust device installed in the facility; and a local exhaust air valve that regulates an exhaust flow rate of the local exhaust device, wherein the controller is further configured to control the local exhaust air valve so that a planar air speed in a plane of a sash of the local exhaust device goes to a prescribed value, and the controller is further configured to determine the supply flow rate that is regulated by the supply air valve and the common exhaust flow rate that is regulated by the common exhaust air valve so that the difference between the supply flow rate, regulated by the supply air valve, and the exhaust flow rate, regulated by the common exhaust air valve, will match the prescribed set point.

3. The flow rate controlling system as set forth in claim 2, wherein the controller is further configured to notify a user of the local exhaust device that there is a fault in the supply air valve or the common exhaust air valve when there is a fault in at least one of the supply air valve and the common exhaust air valve.

4. The flow rate controlling system as set forth in claim 3, wherein the controller is further configured to monitor a state of the local exhaust air valve; and notify the user of the local exhaust device that there is a fault in the local exhaust air valve when there is a fault in the local exhaust air valve.

5. The flow rate controlling system as set forth in claim 2, wherein the controller is further configured to prevent opening/shutting of the sash of the local exhaust device, by controlling a mechanism for preventing opening/shutting of the local exhaust device, when there is a fault in at least one of the supply air valve and the common exhaust air valve.

6. The flow rate controlling system as set forth in claim 5, wherein the controller is further configured to monitor a state of the local exhaust air valve; and prevent opening/shutting of the sash of the local exhaust device, through controlling an opening/shutting preventing mechanism of the local exhaust device, when there is a fault in the local exhaust air valve.

7. A flow rate controlling method, including:

determining, by a controller including a CPU, a supply flow rate, regulated by the supply air valve, and a common exhaust flow rate, regulated by a common exhaust air valve, so as to cause a difference between the supply flow rate, regulated by the supply air valve, and the exhaust flow rate, regulated by the common exhaust air valve, to match a prescribed set point;

controlling, by the controller, a master valve to produce a corresponding flow rate in the master valve, as determined by the controller, when, of the supply air valve and the common exhaust air valve, one is defined as the master valve and the other is defined as a follower valve;

controlling, by the controller, the follower valve to produce a flow rate corresponding to the follower valve, as determined by the controller, monitoring, by the controller at regular scheduled periods, states of the supply air valve and the common exhaust air valve; and issuing, by the controller, a flow rate change instruction according to a schedule that is established in advance or an instruction from outside, wherein:

when both (i) the flow rate change instruction is received, and (ii) there is a fault in at least one of the supply air valve and the common exhaust air valve, the controller further maintains the supply flow rate and the common exhaust flow rate without changing either the supply flow rate or the common exhaust flow rate.

8. The flow rate controlling method as set forth in claim 7, further including:

controlling, by the controller, a local exhaust air valve so that a planar air speed in a plane of a sash of a local exhaust device that is provided in a facility will go to a prescribed value, wherein:

the controller determines the supply flow rate that is regulated by the supply air valve and the common exhaust flow rate that is regulated by the common exhaust air valve so that the difference between the supply flow rate, regulated by the supply air valve, and the exhaust flow rate, regulated by the common exhaust air valve, matches the prescribed set point.

9. The flow rate controlling method as set forth in claim 8, further including:

notifying, by the controller, a user of the local exhaust device that there is a fault in the supply air valve or the common exhaust air valve when there is a fault in at least one of the supply air valve and the common exhaust air valve.

10. The flow rate controlling method as set forth in claim 9, wherein:

the controller monitors a state of the local exhaust air valve; and the controller notifies the user of the local exhaust device that there is a fault in the local exhaust air valve when there is a fault in the local exhaust air valve.

11. The flow rate controlling method as set forth in claim 8, further including:

preventing, by the controller opening/shutting of the sash of the local exhaust device, by controlling a mechanism for preventing opening/shutting of the local exhaust device, when there is a fault in at least one of the supply air valve and the common exhaust air valve.

12. The flow rate controlling method as set forth in claim 11, wherein:

the controller monitors a state of the local exhaust air valve; and the controller prevents opening/shutting of the sash of the local exhaust device, through controlling an opening/shutting preventing mechanism of the local exhaust device, when there is a fault in the local exhaust air valve.

* * * * *